United States Patent [19]

Hancock

[11] 4,256,142

[45] Mar. 17, 1981

[54] HYDRAULIC CONTROL

[76] Inventor: Leonard H. Hancock, c/o FWD Truck & Equipment, Box 1528, Harrisburg, Pa. 17105

[21] Appl. No.: 67,751

[22] Filed: Aug. 20, 1979

[51] Int. Cl.[3] ..... F15B 13/08

[52] U.S. Cl. ..... 137/596; 91/532; 137/596.13

[58] Field of Search ..... 91/532; 137/596, 596.13

[56] References Cited

U.S. PATENT DOCUMENTS 3,077,901 2/1963 Klessig ..... 137/596.13

*Primary Examiner*—Gerald A. Michalsky

*Attorney, Agent, or Firm*—Thomas Hooker

[57] ABSTRACT

A stacked parallel valve assembly adapted for use on a highway dump truck or the like where primary hydraulic cylinders are actuated by shifting valves in the assembly and pressure fluid flowing through the assembly is continuously available to power a downstream hydraulic accessory or accessories such as an auger, spreader or cylinder.

6 Claims, 6 Drawing Figures

Fig. 1
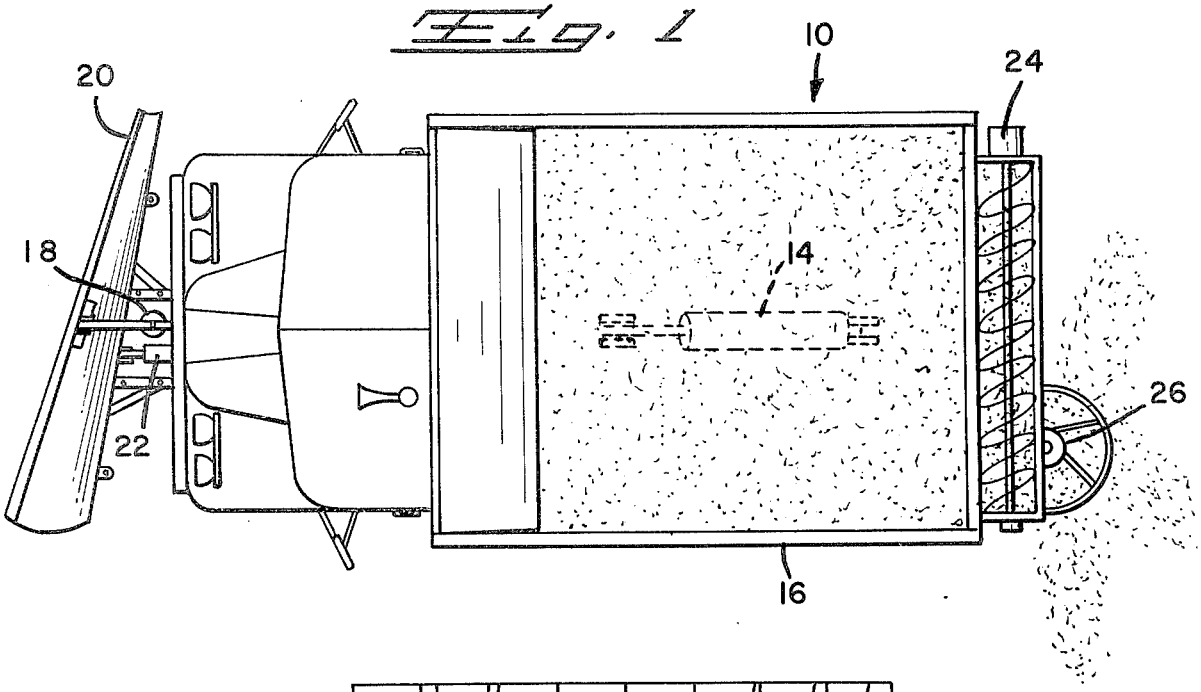
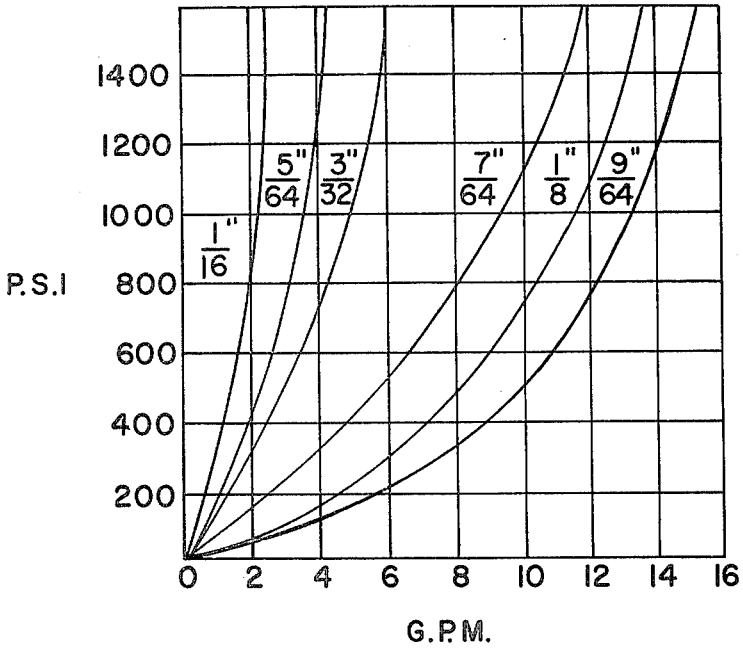
Fig. 6

HYDRAULIC CONTROL

This invention relates to an improved hydraulic control for the highway dump trucks or the like having a hydraulic system using a stacked parallel valve for actuation of primary hydraulic power cylinders used, for instance, to shift the bed of the dump truck, raise or lower a front plow or shift the right-left orientation of the plow together with one or more accessory hydraulic motors or cylinders continuously operated or continuously operable by pressure fluid flowing downstream through the parallel stacked valve.

On conventional highway snow plow and spreader trucks, actuation of one of the valves of the parallel stacked valve completely deactivates the spreader and auger. As a result, the spreader and auger do not operate during the time the primary valve is shifted to a work position and the portion of the highway traveled by the truck during that time is not treated. The disadvantages of this system are readily apparent. Sudden unexpected discontinuance of spreading results in untreated portions of the road highly dangerous to motorists who expect continuous highway treatment.

The invention is particularly useful on highway dump trucks where auger and broadcast spreader motors are driven by pressure fluid flowing downstream through a parallel stacked valve. Shifting of any of the valves actuates a primary hydraulic cylinder without deactivating the spreader and auger motors. The roadway is continuously treated despite shifting of the plow or truck bed.

The improved hydraulic control provides a continuous flow of pressure fluid downstream from a stacked parallel valve assembly, whether or not the unit powered by the downstream flow is continuously operated or is continuously available for operation such as by manually shifting a control valve. This advantage is important where it is desired to add a hydraulic powered accessory to a pre-existing unit having a stacked parallel valve and to power that accessory by the existing hydraulic control. For instance, an accessory wing plow may be added to a road grader having a parallel stacked valve control for the blade angle and rake. The continuous high-pressured carry-beyond feature of the invention provides a continuous supply of pressure fluid to actuate a cylinder for extension or retraction of the accessory wing plow to increase the width of the main plow for snow plowing. The wing plow cylinder is extended or retracted through a conventional hand-operated on-off valve. This type of accessory can be attached to a conventional unit by an inexpensive and rapidly performed modification of the downstream valve in the conventional parallel stacked valve.

Other objects and features of the invention will become apparent as the description proceeds, especially when taken in conjunction with the accompanying drawings illustrating the invention, of which there are four sheets and one embodiment.

In the Drawings

FIG. 1 is a top view of a highway dump truck illustrating a number of primary and downstream hydraulic units operated by the improved hydraulic control of the present invention;

FIG. 6 is a graph illustrating the flow rate of high pressure fluid carried downstream as a function of the pressure of the primary fluid with different sized control orifices.

DESCRIPTION OF THE HYDRAULIC CONTROL

Figure 2:
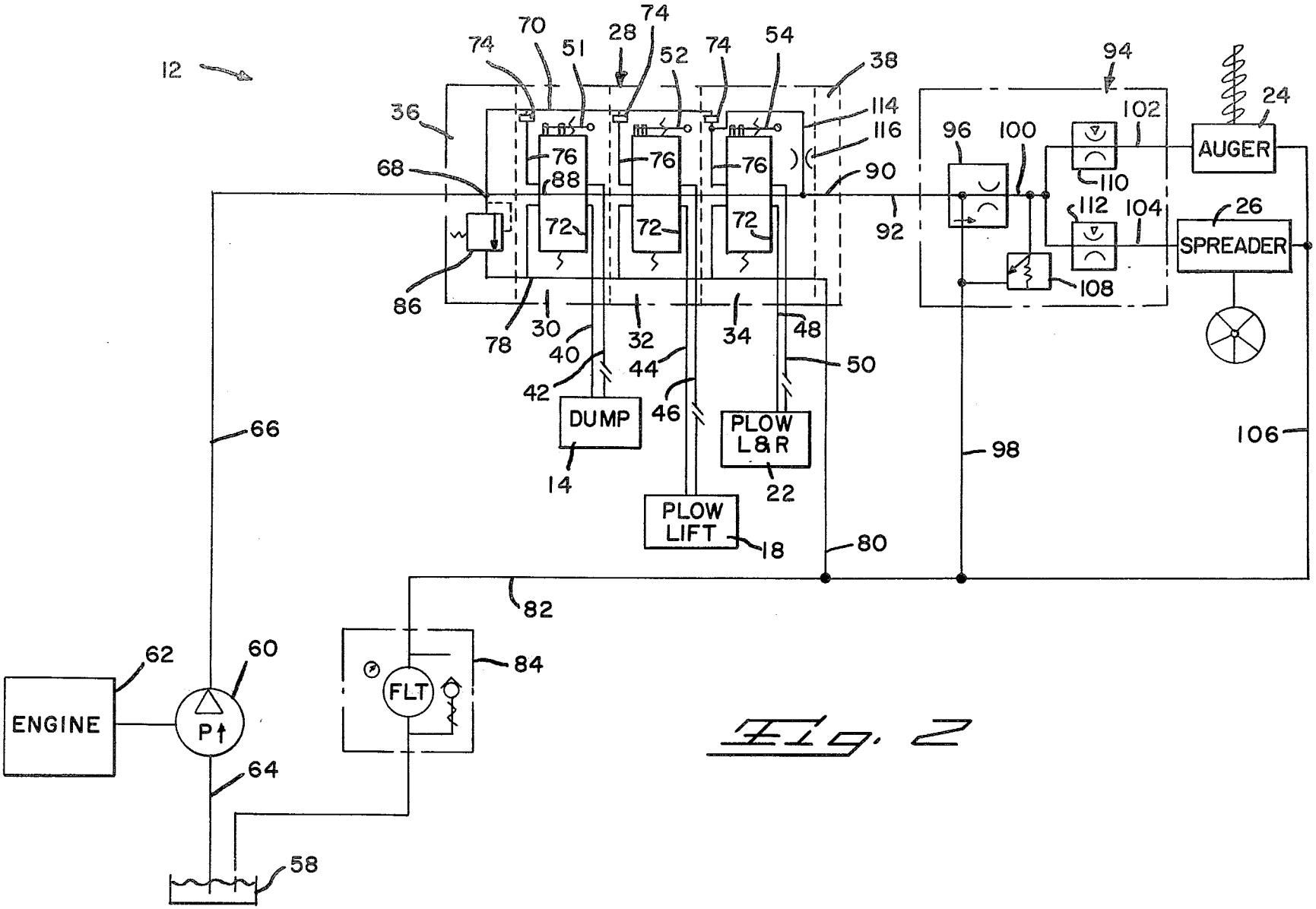
FIG. 2 is a schematic hydraulic circuit diagram of the control used in the truck of FIG. 1.

Referring now primarily to FIGS. 1 and 2, highway dump truck 10 includes a hydraulic control 12 manually operable by the driver in order to extend or retract the primary dump cylinder 14 to raise or lower dump bed 16; extend or retract primary plow lift hydraulic cylinder 18 to raise or lower roadway plow 20; or extend or retract primary plow tilt cylinder 22 to tilt the plow 20 to the left or right. The truck 10 also includes a hydraulically driven auger motor 24 which rotates an auger to convey particulate material carried in bed 16, conventionally salt or cinders, across the back of the bed to a rotary broadcast spreader rotated by hydraulic motor 26. During spreading by truck 10, the auger and spreader motors 24 and 26 are operated continuously despite manual shifting of spool valves in control 12 to selectively extend or retract the primary cylinders 14, 18 and 22.

The hydraulic control 12 includes a stacked parallel circuit valve 28 having three individual valve units 30, 32 and 34 with suitable upstream and downstream end plates 36 and 38. Hydraulic lines 40 and 42 connect valve unit 30 to dump cylinder 14, hydraulic lines 44 and 46 connect valve unit 32 to plow lift cylinder 18 and hydraulic lines 48 and 50 connect the downstream valve unit 34 to plow tilt cylinder 22. The valve units 30, 32 and 34 each include a manually actuable handle so that the dump truck operator may shift the spools in the valve units to either extend or retract the cylinders 14, 18 and 22. Handle 51 shifts the spool of the upstream valve unit 30, handle 52 shifts the spool of valve unit 32 and handle 54 shifts the spool of the downstream valve unit 34. Obviously, the handles could be replaced by other suitable spool shifting devices such as solenoids or pressure operated actuators.

The hydraulic control of FIG. 2 includes a hydraulic fluid reservoir 58 and a high pressure hydraulic fluid pump 60 preferably driven by truck engine 62. Pressure line 64 extends from the reservoir to the input port of the pump and pressure line 66 extends from the output port of the pump to the pressure fluid inlet of port 68 on the upstream end plate 36 of stacked parallel valve 28. If desired, a conventional pressure relief valve may be provided in pressure line 66 so that if the line pressure exceeds a working maximum, the valve opens and relieves the pressure by flowing fluid back to reservoir 58.

The valve units and end plates are suitably held together by bolts at their faying faces to define a parallel work port cavity or pressure line 70 extending from inlet port 68 through end plate 36 and into each of the bodies of valve units 30, 32 and 34. The work port cavity 70 is connected to the spool bore 72 of each valve unit through a one-way check valve 74 and a pressure fluid line 76.

The stacked parallel valve 28 includes a pressure fluid return line 78 extending through the valve units 30, 32 and 34 and into the end plates 36 and 38. The return line 78 in the valve 28 joins exterior return line 80 at downstream end plate 38. Line 80, in turn, joins return line 82 which extends through a suitable hydraulic fluid filter unit 84 and extends back to the reservoir 58. In this way, hydraulic fluid flowing through line 78 is channeled back to the reservoir. The part of the return passage 78 in each valve unit extends to a port in spool bore 72 of the unit. A pressure relief bypass valve 86 is provided in the upstream end plate 36 between the high-pressure inlet port 68 and the return line 78. In the event the pressure of hydraulic fluid at the inlet port exceeds a working value, the valve automatically opens to reduce pressure and drain fluid back to the reservoir through lines 78, 80 and 82. The pairs of hydraulic work lines 40, 42; 44, 46; and 48, 50 are attached to suitable inlet and outlet work ports on the valve unit to communicate with ports in the spool bores 72.

When the spools of the three valve units 30, 32 and 34 are in the neutral position so that hydraulic fluid is not pumped to extend or retract the primary power cylinders, the spools within bores 72 cooperate to define a central high-pressure carryover passage 88 extending from high-pressure inlet port 68 through the valve units and to a high-pressure outlet port 90 on downstream end plate 38. Shifting of any of the spools in the valve units 30, 32 and 34 closes the high-pressure carryover passage 88 to prevent fluid flowing through the passage to the outlet port 90.

A high pressure line 92 extends from the high-pressure outlet port 90 to a downstream hydraulic control unit 94 for the auger and spreader motors 24 and 26. The control unit 94 includes an on-off lever valve 96 which, depending upon its position, directs the fluid flowing through line 92 either through return line 98 and back to reservoir 58 or through line 100 and lines 102 and 104 to the auger and spreader motors 24 and 26 and thence back to the reservoir through return lines 106 and 82. A spring-backed pressure relief valve 108 connects high-pressure line 100 with return line 98. Adjustable flow orifices 110 and 112 located in lines 102 and 104 apportion the flow through line 100 to the auger and spreader motors and thereby assuring that each motor receives its required volume of pressure fluid to assure proper operation. On-off valve 96 includes a metering orifice to limit total flow through line 100.

Figure 3:
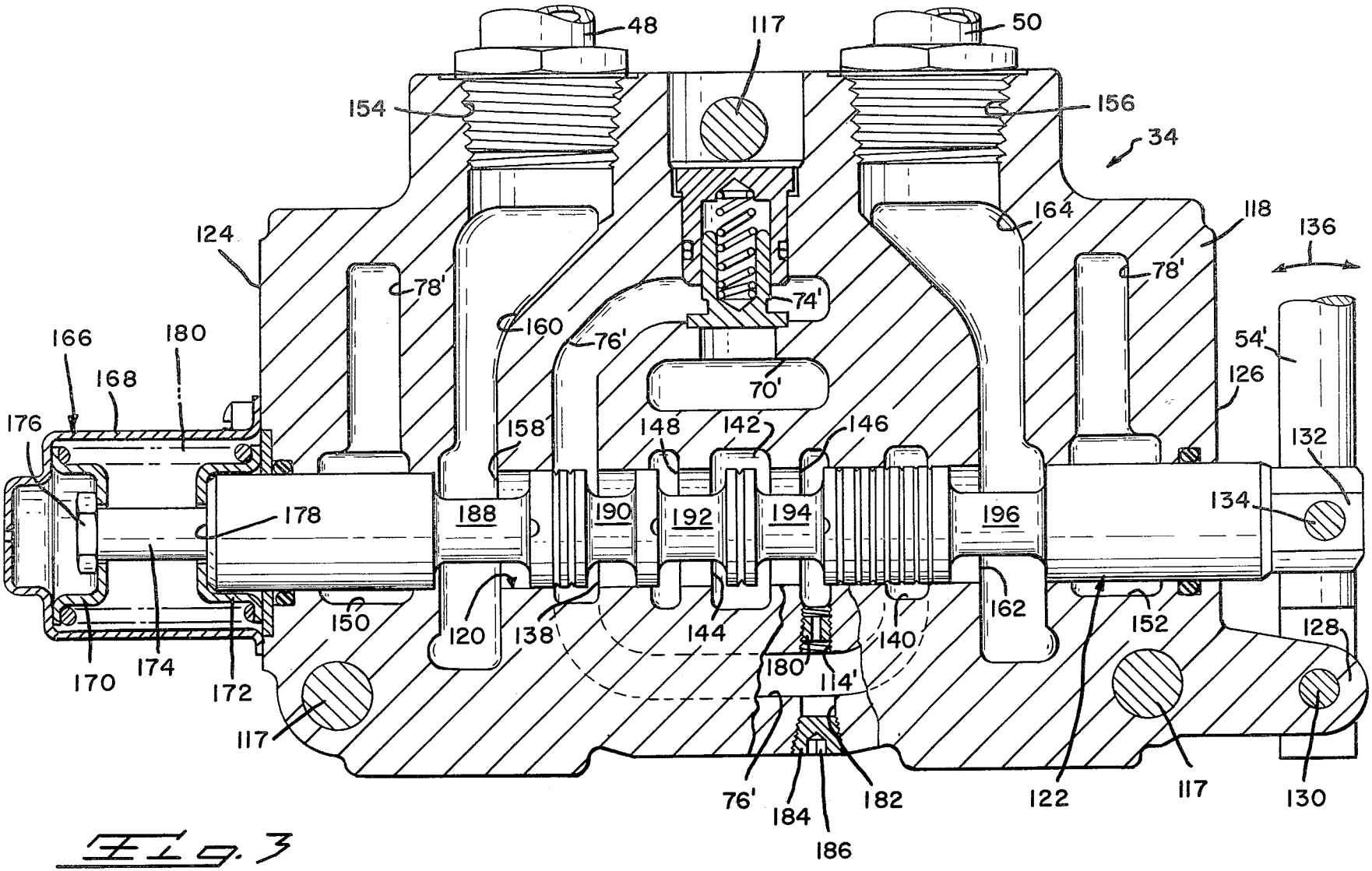
FIG. 3 is a sectional view, partially broken away, through the downstream section of the parallel stack valve of the hydraulic unit looking upstream and showing the spool in the centered position.
Figure 4:
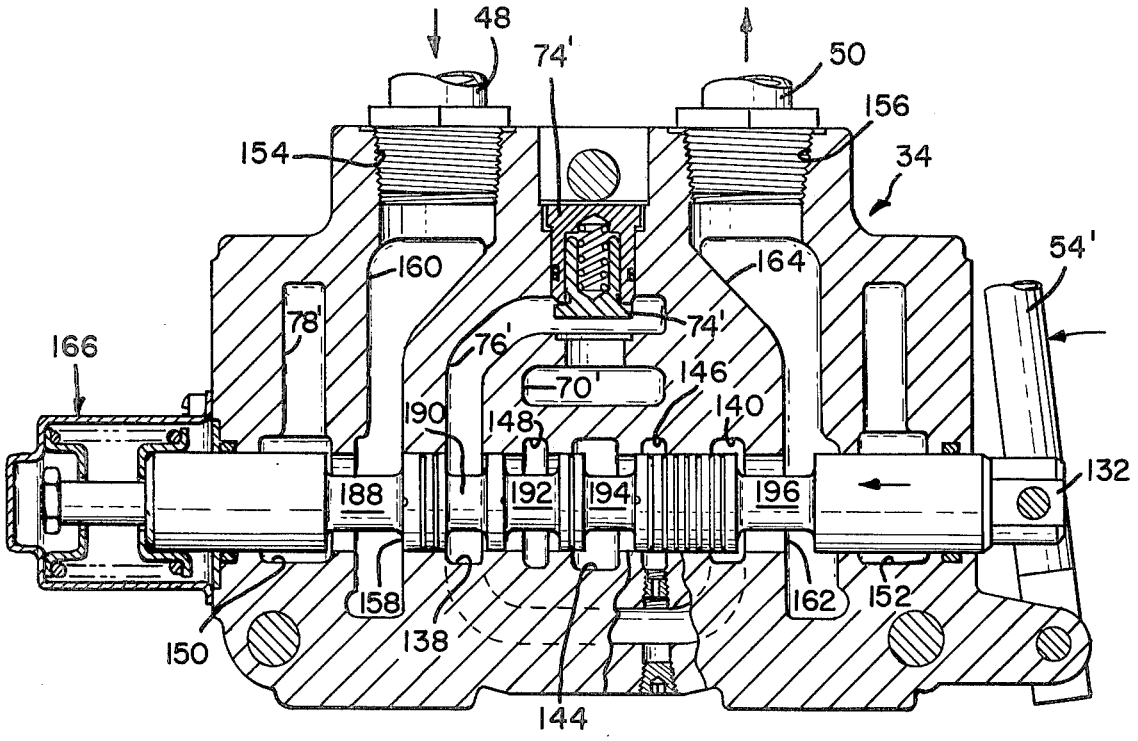
FIGS. 4 and 5 are sectional views similar to that of FIG. 3 showing the spool in different work positions.
Figure 5:
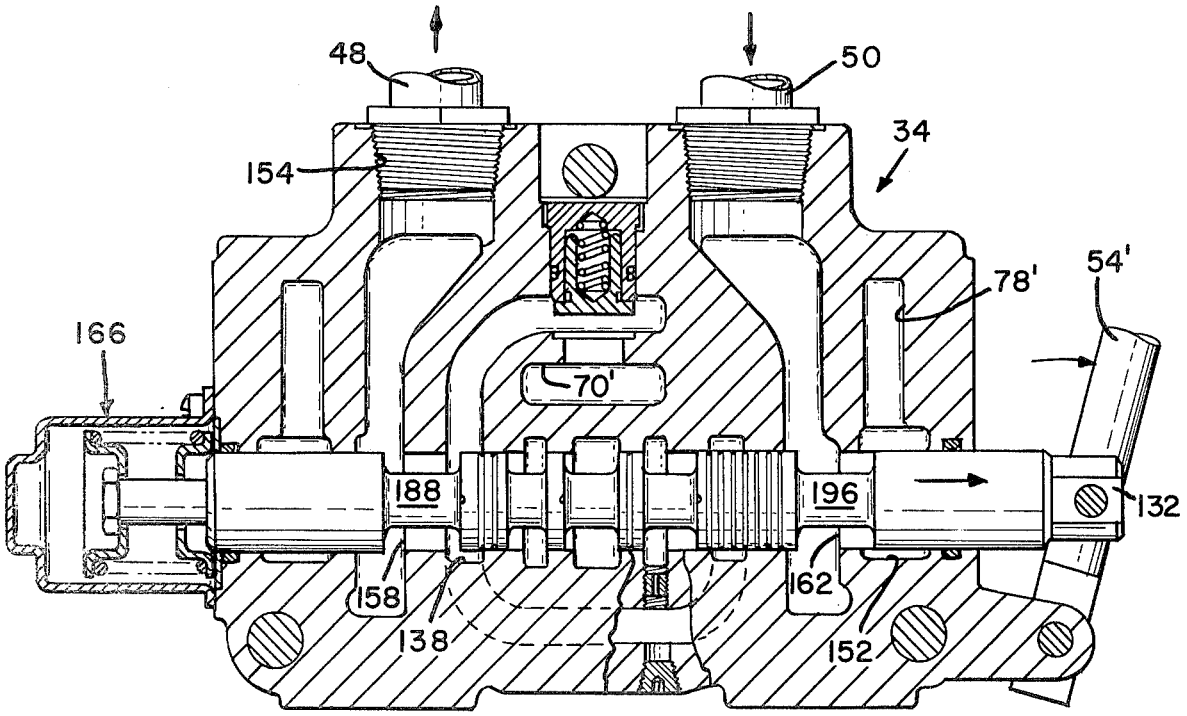

As illustrated in FIG. 2 and, more clearly, in FIGS. 3, 4 and 5, the downstream valve unit 34 includes a high-pressure carryover passage 114 extending from the feed passage 76 of the valve to the high-pressure carryover passage 88 extending through the valve at a point located downstream of spool bore 72. A restriction orifice 116 is provided in passage 114 to meter the flow from the pressure fluid through the passage and to the control unit 94 when one of the spools of valve units 30, 32 and 34 is shifted to a work position to extend or contract a primary cylinder 14, 18 or 22 and thereby close passage 88 at the bore of the shifted spool.

FIGS. 3, 4 and 5 are vertical sectional views taken through the center of the spool bore of the downstream valve unit 34. The valve unit includes a cast metal body 118 with a cylindrical spool bore 120 extending through the body from side to side. Valving spool 122 is fitted within bore 120 and extends outwardly beyond both valve sides 124 and 126. Manual control handle 54 is pivotally secured to body ear 128 by pin 130 and is also connected to spool end 132 by pin 134 so that rotation of the handle back and forth in directions indicated by arrow 136 moves the spool 122 from the central, non-work position of FIG. 3 to the work positions of FIGS. 4 and 5.

The spools and porting arrangements of valve units 30, 32 and 34 are nearly identical. These units are held together between the end plates by bolts 117 so as to form fluid-type joints at their faying surfaces and around the passages extending through such surfaces. The body 118 includes a central passage 70′ which extends between the faying surfaces and forms part of the high-pressure work port line 70 shown in diagrammatic FIG. 2. Line 76′ extends through body 118 from passage 70′ to spool port 138 and thence beneath the bore 120 to spool port 140. One-way check valve 74′ is located in line 76′ between passage 71′ and the spool port 138.

The portion of the high-pressure carryover passage 88 extending through valve unit 34 includes a central first passage 142 extending from the upstream faying face to a central spool port 144. A pair of carryover passage ports 146 and 148 are spaced equally to either side of the central port 144 and are each connected to a continuation portion (not illustrated) of passage 88 extending from the ports 146 and 148 to the downstream faying surface of the valve unit. The high-pressure carryover passage extends from these passages into the downstream end plate to the high-pressure outlet port 90.

The pressure fluid return line 78 of FIG. 2 forms a pair of return passages 78′ each located adjacent a valve side 124, 126, with these passages extending between the faying faces of the valve unit. The return passage 78′ adjacent to side 124 communicates with a return spool port 150 and the return line 78′ adjacent side 126 communicates with return spool port 152.

Each valve unit includes a pair of work ports which are connected to the lines leading to the hydraulic cylinder controlled by the valve unit. Valve unit 34 includes work ports 154 and 156 connected respectively to hydraulic lines 48 and 50 extending to primary cylinder 22. The work port 154 communicates with spool port 158 through interior passage 160. Work port 156 communicates with spool port 162 by way of interior passage 164.

The end of spool 122 adjacent valve side 124 is attached to a conventional centering device 166 which returns the valve spool from the work positions of FIGS. 4 and 5 to the centered position of FIG. 3 when the handle 54 is released. Unit 166 includes a cylindrical cap 168 secured to the valve side 124 and a pair of washers 170, 172 which are freely confined on spool shaft 174 between stop nut 176 and spool shoulder 178. A spring 180 is confined between the outer flanges of the washers and biases the washers against the nut and spool end shoulder 178. Shifting of the spool to the left or right as shown in FIGS. 4 and 5 moves one of the washers away from the rest position to compress the spring and bias spool back toward the central position of FIG. 3.

High-pressure control line 114′ extends between the part of the high-pressure feed line 76′ adjacent to spool port 140 to assure a continuous flow of high-pressure fluid from the work port cavity 70′ to the high-pressure outlet port 90 and thence to downstream hydraulic control unit 94. In this way, a constant supply of high-pressure fluid is provided to the control unit 94 for continuous operation of the auger and spreader motors 24 and 26. Passage 114′ is interiorly threaded to permit positioning a restriction plug 180 having a central orifice within the passage to thereby control the rate of flow through the outlet port according to the requirements of the downstream unit.

Passage 114 is formed by drilling a bore 182 from the bottom of body 118 into the passage 76' and then drilling a smaller bore from passage 76' into the spool port 146. The smaller bore is then threaded to form passage 114'. The larger diameter of bore 182 permits free movement of the threaded plug 180 through the bore and passage 76 into bore 114'. The plug 180 includes a tool-engagement surface on the end facing passage 76' to permit attachment of a tool for rotation of the plug and fitting within bore 114'.

The bore 182 is threaded and fitted with a sealing plug 184 which is provided with a tool-engagement surface 186 like that of plug 180. The tool-engagement surfaces may be hexagonal for engagement with Allen wrenches.

The valve spool 122 includes a number of annular flow recesses 188, 190, 192, 194 and 196 located between portions of the cylindrical outer circumference of the spool which engage the interior surface of the spool bore 120 to prevent the flow of high-pressure fluid between adjacent spool ports.

Operation of Hydraulic Control

Operation of pump 60 supplies high-pressure hydraulic fluid to the high-pressure inlet port 68 and thence along the work port pressure line 70 and along the high-pressure carryover passage 88. In the event the spools of valve units 30, 32 and 34 are in the central position shown in FIG. 3, passage 88 extends directly between the inlet port 68 and outlet port 90 so that a supply of high-pressure fluid flows through passage 88, the outlet port and through line 92 to the control 94 and hydraulic motors 24 and 26. However, shifting of any of the valve spools to a work position closes the high-pressure carryover passage 88 and prevents flow of fluid through this passage to the outlet port. This condition is illustrated in FIGS. 4 and 5. FIGS. 3, 4 and 5 illustrate the operation of valve unit 34. Unit 34 is identical to units 30 and 32 with the exception of the bores 114' and 182 and plugs 180 and 184. Accordingly, the figures will be used to describe the operations of the hydraulic control.

In valve units 30, 32 and 34, the spool is normally centered by unit 166 with the spool recesses 192 and 194 respectively communicating port 144 with ports 148 and 146. This establishes fluid flow communication along the high-pressure carryover passage 88 between the faying surfaces of the valve unit. As illustrated in FIG. 3, the surfaces of the spool engage the interior surfaces of the bore to prevent fluid flow communication between any of the other spool ports and in this way prevent flow of fluid to or from the work ports 154 and 156. This assures that the primary hydraulic cylinder controlled by the valve unit cannot shift.

With all three valve units 30, 32 and 34 in a centered position of FIG. 3, passage 88 is open from the high-pressure inlet port 68 to the high-pressure outlet port 90 to permit free flow of the high-pressure hydraulic fluid through the valve units and to downstream control unit 94, thus assuring an adequate supply of pressure fluid for operating motors 24 and 26. Relief valves 86 and 108 prevent the build-up of pressure in the hydraulic fluid above the normal working range by dumping excess fluid back into reservoir 58.

FIG. 4 illustrates the spool of valve unit 34 shifted to the left from the neutral or centered position of FIG. 3. Shifting of the spool to this position moves all of the spool recesses to the left so that recess 196 communicates ports 140 and 162; recesses 190, 192 and 194 no longer communicate any ports; and recess 188 communicates ports 150 and 158. In this position, the work port pressure line 70' is in fluid flow communication with the work port 156 through line 76', port 140, spool recess 196, port 162 and line 164. Likewise, the work port 154 is in communication with the pressure fluid return line 78' through passage 160, port 158, recess 188 and port 150. Pressure fluid is free to flow through the high-pressure line 70', open one-way valve 74' and through the valve body to pressure line 50 to cylinder 22 thereby extending or retracting the cylinder. Pressure fluid forced from the cylinder flows through pressure line 48 into work port 154 and through the valve to the return line 78'.

FIG. 5 illustrates valve unit 34 with the spool shifted to the right so that spool recess 196 communicates ports 152 and 162 and spool recess 188 communicates ports 138 and 158. The remaining spool ports are closed. With the spool of the valve unit in this position, pressure fluid flows from the work port pressure line 70' to work port 154 and pressure line 48 while pressure line 50 is communicated with return line 78'. Valve port 144 is closed from valve ports 146 and 148 thereby closing the portion of the high-pressure carryover passage 88 extending between the faying surfaces of the valve unit and preventing the flow of high-pressure fluid through this passage to the outlet port 90 and unit 94.

From the preceding description, it will be seen that shifting of the spool in any of the valve units 30, 32 and 34 to either the right or left work positions blocks the flow of pressure fluid through the high-pressure carryover passage 88 to the outlet port 90. Shifting of a valve spool does not, however, block the work port pressure line 70' which continuously pressurizes individual segments 76' of each valve unit, including the downstream valve unit 34. The restrictive fluid flow orifice in plug 180 of the downstream valve unit 34 provides a continuous flow path for high-pressure fluid from the work fluid pressure line 70' to the outlet port 90 thereby assuring a continuous metered flow of work fluid to the hydraulic control unit 94 and motors 24 and 26. This flow assures that the motors are continuously supplied with hydraulic fluid and do not stop when any of the valve units of the stacked parallel valve 28 are shifted to extend or contract to their respective primary power cylinders. In the event the spool of an upstream valve unit is shifted to close passage 88, fluid flowing from passage 70' of valve unit 34 will open the one-way check valve 74' flow through line 76' and the orifice of plug 180 into the valve port 146 and thence downstream into the end plate 38 and to the outlet port 90.

The flow of hydraulic fluid through line 114' of the downstream valve unit 34 is adjusted to provide a sufficient volume of pressure fluid for operation of the downstream units driven by the fluid. In the system illustrated in FIG. 2, these units include the auger motor 24 and spreader motor 26. The adjustable orifices 110 and 112 split the pressure fluid flowing into control unit 94 to assure that the motors 24 and 26 each receive fluid at a proper rate for efficient operation. For instance, the orifices may be adjusted to provide spreader motor 26 with hydraulic fluid at the rate of three gallons a minute and the auger motor 24 with hydraulic fluid at the rate of seven gallons a minute. Different size motors and different applications will, of course, require different adjustments of the orifices.

The graph of FIG. 6 illustrates the rate of flow of high-pressure fluid through orifice 116 in gallons per minute for different pressures of the fluid on the upstream side of the orifice as supplied by pump 60. Curves are plotted on the graph for different orifice diameters. The orifices may be drilled in the plug. The graph enables the operator to calculate the appropriate size orifice for use in a given application in order to assure a downstream or carryover flow of pressure fluid for a given application. New plugs 180 are quickly and easily installed in the valve body 118.

While I have illustrated and described preferred embodiment of my invention, it is understood that these are capable of modification, and I therefore do not wish to be limited to the precise details set forth, but desire to avail myself of such changes and alterations as fall within the purview of the following claims.

What I claim as my invention:

1. An improved hydraulic control of the type used on a highway dump truck or the like including a stacked parallel circuit valve assembly having a plurality of stacked spool valve units, the units including an upstream valve unit and a downstream valve unit, a high-pressure inlet port located upstream of the upstream valve unit, a downstream high-pressure outlet port located downstream of the downstream valve unit, a spool bore and a valving spool in each valve unit, the spool having a central non-work position within the bore and work positions to either side of the central position, means for shifting the valve from the central position to the work positions, a work port pressure line extending from said inlet port into all of said valve units and communicating with the spool bores of said valve units, a pressure fluid return line communicating with the valve bores of said valve units for returning pressure fluid therefrom outwardly of the valve, a pair of work ports on each valve unit adapted to be connected by hydraulic lines to a primary hydraulic device, a high-pressure carryover passage extending from the inlet port through the spool bores of said valve units to said outlet port, each spool valve including means for closing said high-pressure carryover passage upon shifting of the spool from the central position to a work position and for opening said high-pressure carryover passage when the spool is in the central position, and a high-pressure control line communicating the portion of the work port pressure line in the downstream valve unit adjacent the spool bore of said such unit with the portion of the high-pressure carryover in such unit located between the spool bore of such unit and the outlet port, said high-pressure control line including a restricted orifice for limiting the flow of hydraulic fluid from the inlet port through the work port pressure line, high-pressure control line and the downstream portion of the high-pressure carryover passage to the outlet port whereby upon connection of a source of high-pressure hydraulic fluid to the inlet port and connection of primary hydraulic devices to each of said valve units and connection of downstream hydraulic device to the outlet port, pressure hydraulic fluid is supplied to the downstream hydraulic device through the high-pressure control line when one of the valve units is shifted to a work position to operate a primary hydraulic device and thereby close the high-pressure carryover passage.

2. An improved hydraulic control as in claim 1 wherein the downstream valve unit includes a first passage extending into the valve unit from the exterior surface thereof and within the interior of the valve unit communicating said high-pressure control line with said high-pressure carryover passage, and means for sealing such first passage against high-pressure fluid flow located at the end of the passage adjacent to the exterior surface of the valve unit.

3. An improved hydraulic control as in claim 2 wherein said passage includes a pair of coaxial bores, one bore extending from the exterior surface of the valve unit to said high-passage control line and the other bore extending from said high-pressure control line through the valve unit to said high-pressure carryover line, the interior diameter of the first bore being greater than the interior diameter of the second bore.

4. An improved hydraulic control as in claim 3 wherein the interior surface of the second bore is threaded and including a threaded plug located within said second bore and threadably engaged with the threads of such bore, said plug having a generally central orifice.

5. An improved hydraulic control as in claim 4 wherein the side of said plug adjacent the outside of the valve unit includes tool-engagement means whereby the plug may be removed by removing said means for sealing and inserting a tool through said bores and engaging the plug.

6. An improved hydraulic control as in claim 5 wherein said means for sealing includes a threaded plug, the interior surface of said first bore is threaded and said threaded plug is threadably engaged within such bore.

* * * * *